United States Patent [19]

Morino

[11] 4,305,893

[45] Dec. 15, 1981

[54] VARIABLE VENTURI TYPE CARBURETOR

[75] Inventor: Toshiharu Morino, Mie, Japan

[73] Assignee: Aisan Industry Co., Ltd., Aichi, Japan

[21] Appl. No.: 165,898

[22] Filed: Jul. 3, 1980

[30] Foreign Application Priority Data

Jul. 12, 1979 [JP] Japan ..... 54-96241[U]

[51] Int. Cl.[3] ..... F02M 9/06

[52] U.S. Cl. ..... 261/44 C

[58] Field of Search ..... 261/44 C

[56] References Cited

U.S. PATENT DOCUMENTS 3,784,173 1/1974 Kawai et al. ..... 261/44 C
4,185,054 1/1980 Nakamura et al. ..... 261/44 C

FOREIGN PATENT DOCUMENTS 4729152 1/1972 Japan .
4928849 7/1974 Japan .
5457031 8/1979 Japan .
1537491 12/1978 United Kingdom ..... 261/44 C

*Primary Examiner*—Tim R. Miles

[57] ABSTRACT

A variable venturi type carburetor having a suction piston movable in response to the intake air flow rate to maintain a substantially constant flow velocity at a venturi portion defined between itself and the opposing wall of the carburetor body, the suction piston being provided at its bottom with a pair of partition plates having exponential, arcuate or tapered end surfaces, in order to suppress self-excited oscillation of the suction piston. The pair of partition plates being opposed by a bridge formed on the wall of the carburetor body to form therebetween a diverging opening. The distance between the pair of partition plates and the bridge is independently adjustable to make it possible to maintain a desired size of gap to avoid the fluctuation of fuel metering characteristics.

1 Claim, 3 Drawing Figures

VARIABLE VENTURI TYPE CARBURETOR

BACKGROUND OF THE INVENTION

The present invention relates to a variable venturi type carburetor provided with a partition plate formed at the bottom of the suction piston, in order to prevent the self-exciting oscillation of the suction piston.

Such a variable venturi type carburetor has been known as having a partition plate disposed at the bottom of the suction piston, such that the increment of the venturi opening area in relation to the displacement of the suction piston is gradually increased. This type of carburetor can effectively avoid the self-excited vibration of the suction piston without necessitating a damper means such as a hydraulic damper. In this type of carburetor, however, it is necessary to control and manage and gap between the partition plate and the bridge formed on the carburetor body opposing to the partition plate, for otherwise the intake air flowing through this gap will be changed to cause a change in the displacement of the suction piston, i.e. a change in the projection area of the venturi opening, resulting in a fluctuation of operation of the carburetor.

Namely, the relative position between the metering needle attached to the suction piston and the main jet fixed to the carburetor barrel fluctuates even for a constant intake air flow rate, resulting in a variation of the fuel metering area which would deteriorate the precision of control of fuel flow.

SUMMARY OF THE INVENTION

It is, therefore, a major object of the invention to obtain a constant relationship between the intake air flow rate and the displacement of the suction piston, by making the afore-mentioned gap adjustable, thereby to overcome the above-described problems of the prior art.

To this end, according to the invention, there is provided a variable venturi type carburetor having a pair of partition plates provided at the bottom of the suction piston and opposed by a bridge formed in the carburetor body to define a diverging opening beneath the suction piston, characterized in that the gap between the pair of partition plates and the bridge is adjustable.

The above and other objects, as well as advantageous features of the invention will become clear from the following description of the preferred embodiments taken in conjunction with the accompanying drawing.

DESCRIPTION OF THE PREFERRED EMBODIMENTS

Figure 1:
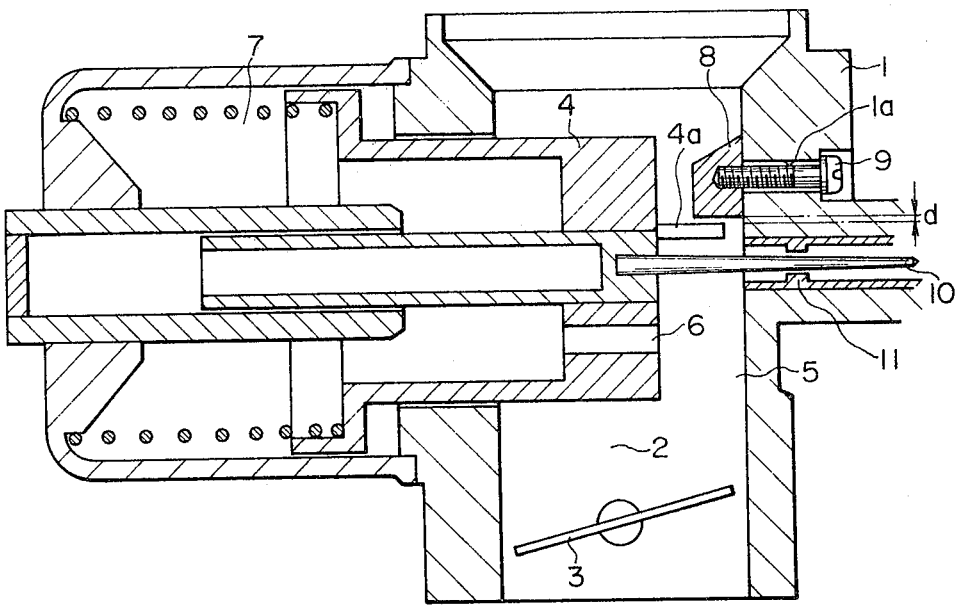
FIG. 1 is a sectional view of a major part of a carburetor constructed in accordance with an embodiment of the invention.
Figure 2:
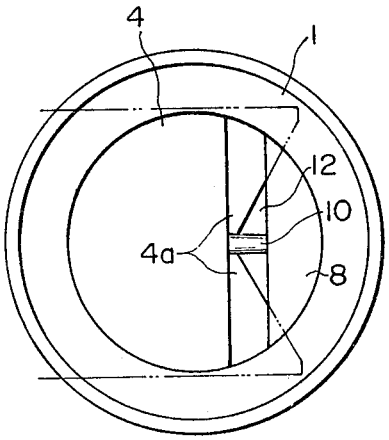
FIG. 2 is a view of the intake passage of the carburetor as viewed from the upstream side.

Referring to FIGS. 1 and 2, a reference numeral 1 denotes a carburetor body having an intake barrel 2 in which there is disposed a throttle valve 3. A suction piston 4 is adapted to be moved into and out of the intake barrel, in accordance with the intake air flow rate, by the force of the vacuum which is generated at the venturi section 5 and transmitted into a suction chamber 7 through a passage 6. Thus, the displacement of the suction piston depends on the magnitude of the vacuum, i.e. the intake air flow rate. A metering needle 10 attached to the suction piston 4 is moved to and from a main jet 11, as the suction piston is displaced, thereby to meter the fuel. A reference numeral **4*a* denotes partition plates provided on the bottom of the suction piston and having a V-shaped planar form. These partition walls cooperate with a bridge 8 attached to the carburetor body to form therebetween a venturi opening 12, the area of which is gradually increased and decreased in relation to the displacement of the suction piston 4. The bridge is secured to the carburetor body 1 by means of a bolt which is received by a bolt hole 1*a* formed in the carburetor body 1 and having a diameter greater than that of the bolt 9. The arrangement is such that the position of the bridge 8 can be varied by varying the position of the bolt in the vertical direction within the bolt hole 1*a*, to permit the adjustment of the gap d between the bridge 8 and the partition plates 4*a***.

Figure 3:
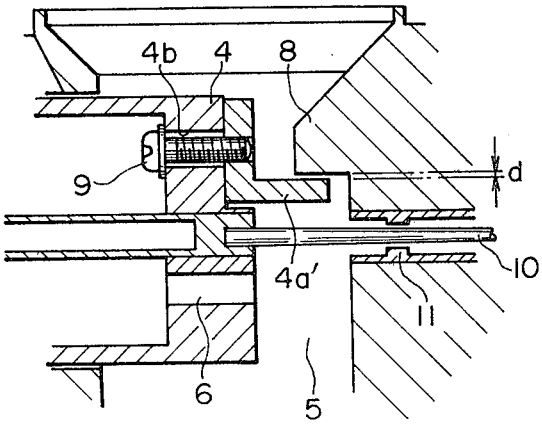
FIG. 3 is a sectional view of another embodiment.

FIG. 3 shows another embodiment in which the partition plates **4*a*′ are formed separately from the suction piston 4 and adjustably secured to the latter. More specifically, the partition plate 4*a*′ is adapted to be secured to the suction piston 4 by means of a bolt 9 (FIG. 3) which is received by a bolt hole 4*b* having a diameter larger than that of the bolt 9 (FIG. 3). The arrangement is such that the partition plate 4*a*′ is adjusted by vertical adjustment of the bolt 9 (FIG. 3) in the bolt hole 4*b*, thereby to permit the adjustment of the gap d. Thus, in this embodiment, the bridge 8** is not adjustable.

As has been described, according to the invention, either the partition plate provided at the bottom portion of the suction piston, the bridge provided on the carburetor body, or both, is formed as an independent, separate part. This separate part (partition plate or bridge) is screwed onto the end portion of a bolt inserted through a larger diameter bore provided in the bottom wall of the suction piston or the wall of the carburetor body. The separate part is held fast against the surface of the bottom portion of the suction piston or the wall of the carburetor body when the head of the bolt is tightened against the surface surrounding the inner end of its bore. Therefore, the partition plate or bridge can be easily installed with the gap d between one of them and the other regulated by tightening or loosening the bolt. Thus, the gap d, which varies greatly due to the tolerance of each part, and each portion of the parts, can be regulated to a suitable level easily at a desired value. It is, therefore, possible to maintain a constant displacement of the suction piston in the small intake air flow region. In consequence, the relative position between the metering needle fixed to the suction piston and the main jet is fixed to offer an advantage of improved precision of the fuel metering.

What is claimed is:

1. In a variable venturi type carburetor having a suction piston adapted to be moved in a direction substantially perpendicular to the direction of flow of intake air in response to the intake air flow rate, and partition plates provided on a bottom of said suction piston having a V-shaped planar form and cooperating with a bridge attached to a wall of the carburetor body in defining a venturi portion, the opening of the latter being progressively increased or decreased in accordance with the displacement of said suction piston, the improvement comprising means for adjusting a gap between said partition plates and said bridge independent of the position of said suction piston, comprising said suction piston and said carburetor body constituting wall members having open end surfaces, said partition plates and said bridge constituting cooperating members, at least one of said cooperating members being formed as an independent single part without being formed integrally with said wall members, respectively, at least one of said wall members if formed with a bore, a bolt having a tip which extends through said bore and projects with said tip beyond a corresponding of said end surfaces and is screwed into and fixed to said independent single part, the latter engaging said corresponding end surface, said bore has a greater diameter than that of said bolt, said bolt having a head with a diameter greater than that of said bore and engaging another of said open end surfaces of said one wall member opposed to said first-mentioned corresponding end surface, said bolt being adjustably inserted into said one bore loosely and movably in the radial direction of said bore with said head thereof engaging said another of said open end surfaces.

* * * * *